US009765764B2

(12) United States Patent
Theodore, Jr.

(10) Patent No.: US 9,765,764 B2
(45) Date of Patent: Sep. 19, 2017

(54) HINGE MECHANISM FOR A VARIABLE DISPLACEMENT COMPRESSOR

(71) Applicant: HALLA VISTEON CLIMATE CONTROL CORP., Daejeon (KR)

(72) Inventor: Michael Gregory Theodore, Jr., Plymouth, MI (US)

(73) Assignee: HANON SYSTEMS, Daejeon-si (KR)

( * ) Notice: Subject to any disclaimer, the term of this patent is extended or adjusted under 35 U.S.C. 154(b) by 496 days.

(21) Appl. No.: 14/246,390

(22) Filed: Apr. 7, 2014

(65) Prior Publication Data

US 2015/0285233 A1 Oct. 8, 2015

(51) Int. Cl.
*F04B 27/10* (2006.01)
*F04B 27/18* (2006.01)

(52) U.S. Cl.
CPC ..... *F04B 27/1072* (2013.01); *F04B 27/1054* (2013.01); *F04B 27/1063* (2013.01); *F04B 27/18* (2013.01); *Y10T 74/18056* (2015.01)

(58) Field of Classification Search
CPC ..... Y10T 74/18056; F04B 27/1054; F04B 27/1063; F04B 27/1072; F04B 27/18
See application file for complete search history.

(56) References Cited

U.S. PATENT DOCUMENTS 4,105,370 A * 8/1978 Brucken ..... F04B 27/0895 417/222.1
4,701,110 A * 10/1987 Iijima ..... F04B 27/1045 184/6.17
5,055,004 A 10/1991 Ebbing et al.
5,417,552 A 5/1995 Kayukawa et al.
5,517,900 A 5/1996 Kimura et al.
5,540,559 A 7/1996 Kimura et al.
5,749,712 A * 5/1998 Umemura ..... F04B 27/1072 417/269
5,974,946 A 11/1999 Kanou et al.
6,098,520 A * 8/2000 Terauchi ..... F04B 27/1054 74/60
6,116,145 A 9/2000 Ota et al.
6,276,904 B1 8/2001 Ota et al.
6,470,761 B1 * 10/2002 Nakamura ..... F04B 27/1072 417/222.1
6,474,955 B1 11/2002 Ota et al.
(Continued)

FOREIGN PATENT DOCUMENTS

EP 0903495 A2 3/1999
EP 1052404 A2 11/2000
(Continued)

*Primary Examiner* — Logan Kraft
(74) *Attorney, Agent, or Firm* — Shumaker, Loop & Kendrick, LLP; James D. Miller

(57) ABSTRACT

A hinge assembly for coupling a rotor assembly to a swash plate assembly in a variable displacement compressor includes a hub integrally formed with the swash plate assembly and a pair of spaced part arms coupled to the hub and extending outwardly therefrom. Each of the arms having an aperture formed in a distal end thereof. At least one support member extending from the rotor assembly and having a slot formed therein. A hinge pin is slideably received in the slot of the at least one support member and received in the aperture of each of the arms to hingedly couple the arms to the at least one support member.

19 Claims, 5 Drawing Sheets

(56) References Cited

U.S. PATENT DOCUMENTS

| | | | | |
|---|---|---|---|---|
| 6,694,864 | B2 | 2/2004 | Kato et al. | |
| 6,860,188 | B2 * | 3/2005 | Pitla | F04B 27/1072 92/12.2 |
| 7,021,193 | B2 | 4/2006 | Pitla et al. | |
| 2001/0029837 | A1 | 10/2001 | Kayukawa et al. | |
| 2010/0316517 | A1 * | 12/2010 | Tanigawa | F04B 27/1054 417/487 |

FOREIGN PATENT DOCUMENTS

| | | | |
|---|---|---|---|
| EP | 1148239 | A2 | 10/2001 |
| EP | 1251274 | A2 | 10/2002 |
| JP | H04303184 | A | 10/1992 |
| JP | H05172046 | A | 7/1993 |
| JP | H06117362 | A | 4/1994 |
| JP | H06147111 | A | 5/1994 |
| JP | H07127569 | A | 5/1995 |
| JP | H0861239 | A | 3/1996 |
| JP | H0968162 | A | 3/1997 |
| JP | H1068380 | A | 3/1998 |
| JP | H1182297 | A | 3/1999 |
| JP | 2001081574 | A | 3/2001 |
| JP | 2002081372 | A | 3/2002 |
| JP | 2002081373 | A | 3/2002 |
| JP | 2002180955 | A | 6/2002 |
| KR | 20010087090 | A | 9/2001 |
| KR | 20090118513 | A | 11/2009 |
| KR | 20100092722 | A | 8/2010 |
| KR | 20120065143 | A | 6/2012 |

* cited by examiner

HINGE MECHANISM FOR A VARIABLE DISPLACEMENT COMPRESSOR

FIELD OF THE INVENTION

The present invention relates to a variable displacement compressor for use in an air conditioning system for a vehicle and more particularly to a hinge assembly for a variable displacement compressor.

BACKGROUND OF THE INVENTION

As commonly known, variable displacement compressors having a swash plate are used hi air conditioning systems of motor vehicles. Such compressors typically include at least one piston disposed in a cylinder of a cylinder block and a rotor assembly operatively coupled to a drive shaft. The swash plate is coupled to and adapted to be rotated by the rotor assembly. The swash plate is variably angled relative to the rotor assembly between a minimum angle and a maximum angle. Each piston slidably engages with the swash plate through a shoe as the swash plate rotates causing the piston to reciprocate within the cylinder. As the angle of the swash plate relative to the rotor assembly varies, the stroke of each piston is varied and, therefore, the total displacement or capacity of the compressor is varied. The compressor can include a hinge mechanism to couple the swash plate to the rotor.

In variable displacement compressors having a swash plate, the swash plate is typically made from a ferrous material. The ferrous material exhibits poor bearing properties when the swash plate is slidably engaging with the shoe of the piston. Therefore, copper-based coatings, polymers such as PTFE and $MoS_2$ and thermal sprays are applied to the swash plate to provide a desired bearing interface between the swash plate and the shoe. However, use of the coatings or sprays on the swash plate increases manufacturing cost and complexity. The coating also can warp, blister, and peel causing binding or seizure between the swash plate and the shoe. Additionally, the ferrous material does not provide the swash plate with a suitable mass to facilitate an optimal moment of inertia, which consequently affects the variation of the angle of the swash plate. To overcome these limitations, a swash plate can be made from a copper alloy material such as disclosed in U.S. Pat. No. 5,974,946 to Kanou et al. However, the swash plates made from a copper alloy material are typically separate from the hub and coupled thereto by fastening means. The fastening means to couple the swash plate to the hub can warp or damage the swash plate, thus delimiting an efficiency of the compressor.

Additionally, hinge mechanisms can include support arms. For example, in U.S. Pat. No. 5,540,559 to Kimura et al., a hinge unit of a variable capacity swash-plate type compressor is disclosed. A pair of brackets protrudes from a back surface of a rotary swash plate and a pair of support arms protrudes from the rotor. One end of a guide pin is fixed to each bracket of the rotary swash plate and the other end of the guide pin is fixed to a spherical element. A circular guide hole is linearly formed in each support arm of the rotor. An inner surface of the circular hole works as a guide surface and the spherical element of the guide pin is rotatably and slidably inserted into the circular hole. However, these hinge mechanisms do not maintain a constant top clearance of the piston at a top dead center position (hereinafter "TDC") during swash plate angle variations. Additionally, the support arms of the hinge mechanisms do not provide optimal strength to support resulting loads caused by the reciprocating pistons acting on the swash plate to militate against friction and tipping. Because a sufficient support is not provided under the resultant load, frictional forces in the hinge mechanism and tipping moments of the swash plate are created, thus also delimiting the efficiency of the compressor.

Therefore, there is a continuing need for a hinge assembly comprising a minimal number of parts that exhibits low hysteresis and provides improved balance and bearing properties of the swash plate to operatively maintain a constant TDC position of the pistons.

SUMMARY OF THE INVENTION

Concordant and congruous with the present invention, a hinge assembly comprising a minimal number of parts that exhibits low hysteresis and provides improved balance and bearing properties of the swash plate to operatively maintain a constant TDC position of the pistons has surprisingly been discovered.

According to an embodiment of the invention, a hinge assembly for coupling a rotor assembly to a swash plate assembly in a variable displacement compressor us disclosed. The hinge assembly includes a hub integrally formed with the swash plate assembly. A pair of spaced part arms are coupled to the hub and extend outwardly therefrom. Each of the arms have an aperture formed in a distal end thereof. The hinge assembly further includes at least one support member extending from the rotor assembly and having a slot formed therein. A hinge pin is slideably received in the slot of the at least one support member and received in the aperture of each of the arms to hingedly couple the arms to the at least one support member.

According to another embodiment of the invention, a variable displacement compressor is disclosed. The variable displacement compressor comprises a housing including a cylinder block and a drive shaft disposed therein. The cylinder block having a plurality of cylinders formed therein and a plurality of pistons each received within each of the cylinders. A rotor is rotatably coupled to the drive shaft. A swash plate assembly is slideably coupled to the pistons to cause a reciprocating motion thereof. The swash plate assembly includes a swash plate and a hub integrally formed with the swash plate. The variable displacement compressor further includes a hinge assembly operatively and pivotally coupling to the swash plate assembly to the rotor. The hinge assembly includes a pair of arms press fit into a pair of apertures formed in the hub and extending outwardly therefrom and at least one support member extending from the rotor and having a slot formed therein. A hinge pin is slideably received in the slot of the at least one support member and hingedly couples the arms to the at least one support member.

According to a further embodiment of the invention a variable displacement compressor is disclosed. The compressor includes a housing including a cylinder block and a drive shaft disposed therein, the cylinder block having a plurality of cylinders formed therein and a plurality of pistons each received within each of the cylinders and a rotor assembly rotatingly coupled to the drive shaft and including at least one support member extending therefrom, the at least one support member having a slot formed therein. The compressor further includes a swash plate assembly having an aperture and at least one recess formed therein, the swash plate assembly operatively engaging with the plurality of pistons to cause a reciprocal motion thereof, the swash plate assembly including a swash plate and a hub integrally formed with the swash plate. A pair of arms are coupled to the hub and extend outwardly therefrom, each of the pair of arms having an aperture formed in a distal end thereof. A hinge pin is slideably received in the slot of the support member and the aperture of each of the arms to hingedly couple the rotor assembly to the swash plate assembly. A guide is received in the aperture of the swash plate assembly and slidably couples the swash plate assembly to the drive shaft, the guide having at least one flange received in the at least one recesses of the swash plate assembly.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF EXEMPLARY EMBODIMENTS OF THE INVENTION

The following detailed description and appended drawings describe and illustrate various exemplary embodiments of the invention. The description and drawings serve to enable one skilled in the art to make and use the invention, and are not intended to limit the scope of the invention in any manner. The terms upper, lower, horizontal, and vertical are used with respect to the direction of gravity.

Figure 1:
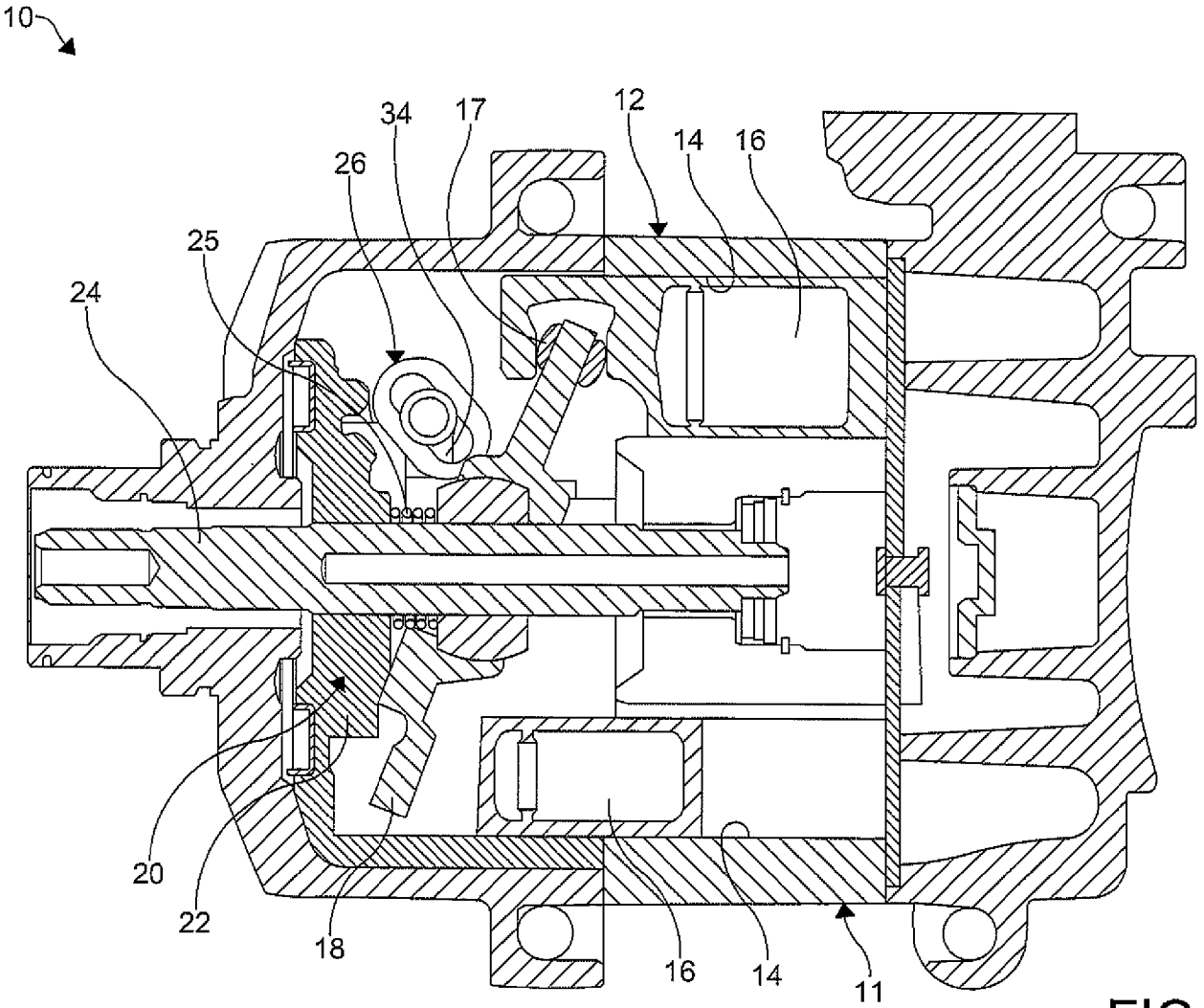
FIG. 1 is a cross-sectional elevational view of a variable displacement compressor according to an embodiment of the invention.

FIG. 1 illustrates a variable displacement compressor 10 according to an embodiment of the invention. The compressor 10 includes a housing 11 with cylinder block 12 disposed therein. The cylinder block 12 includes a plurality of cylinders 14 reciprocatingly receiving a plurality of pistons 16. Bearing shoes 17 operatively engage the pistons 16 with a swash plate assembly 18. The swash plate assembly 18 is rotationally coupled to a rotor assembly 20 to convert rotary movement of the rotor assembly 20 to reciprocating movement of the pistons 16 within the cylinders 14. The rotor assembly 20 includes a rotor 22 rotationally coupled to a drive shaft 24 rotatingly disposed in the housing 11. A hinge assembly 26 operatively couples the swash plate assembly 18 to the rotor assembly 20 and the drive shaft 24. Typically, the drive shaft 24 is caused to rotate by an auxiliary drive means (not shown) such as an engine of a vehicle, for example. A helical spring 25 surrounds an outer surface of the drive shaft 24 and is interposed between the rotor assembly 20 and swash plate assembly 18.

Figure 2:
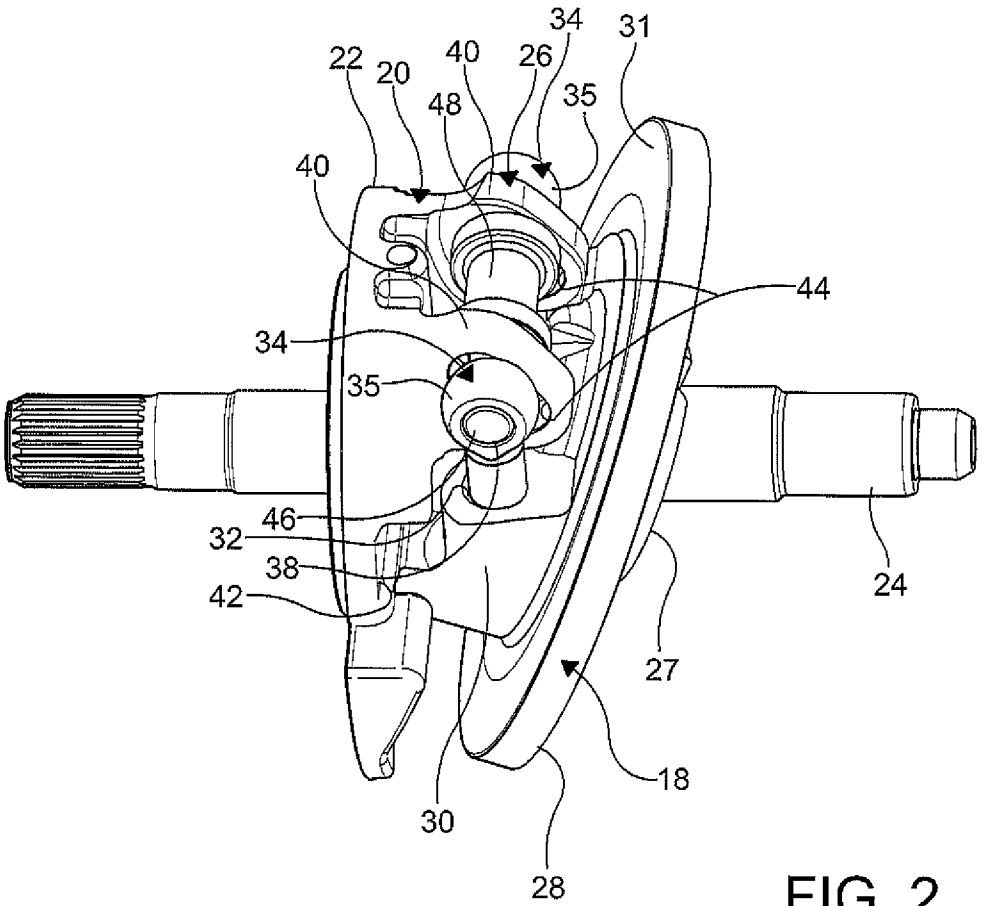
FIG. 2 is a side perspective view of a hinge assembly showing a rotor assembly coupled to a swash plate assembly of the variable displacement compressor of FIG. 1.
Figure 3:
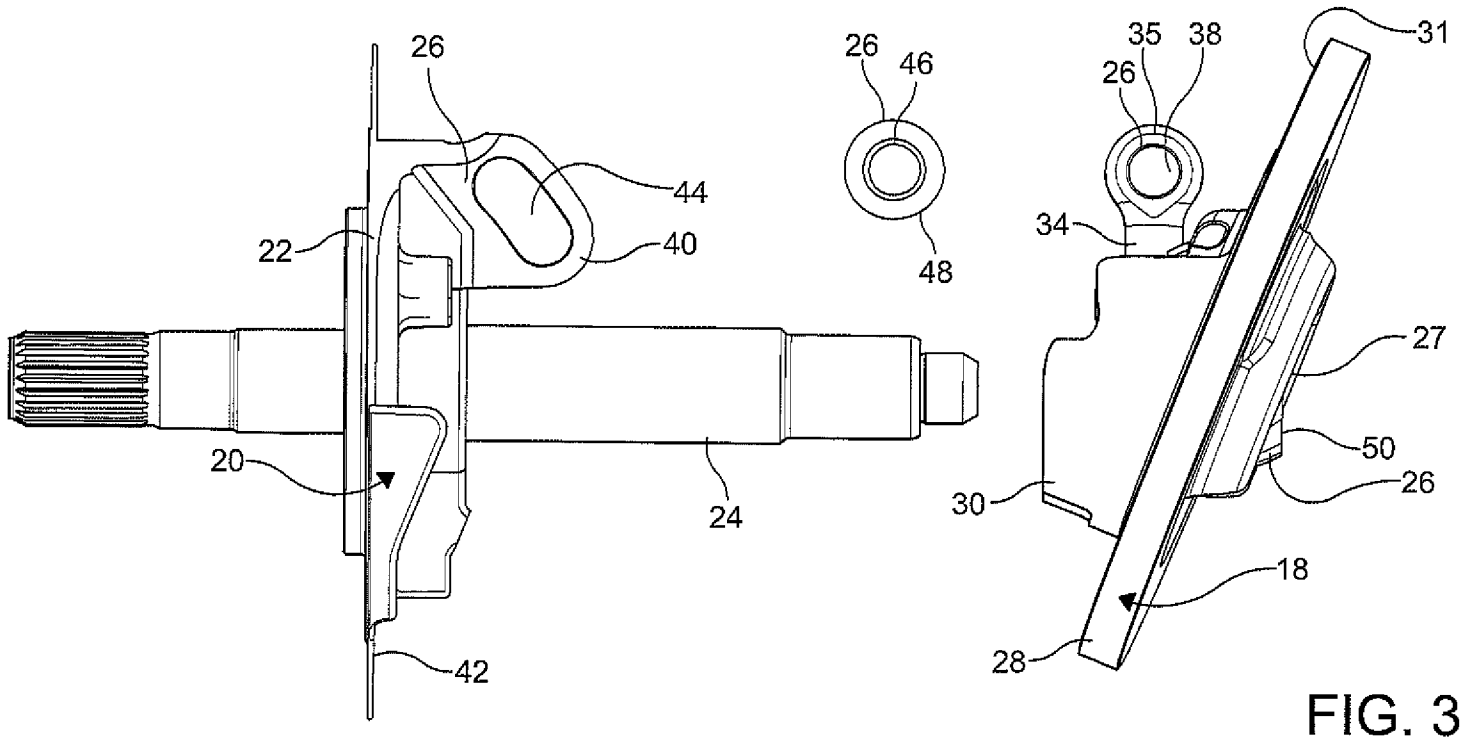
FIG. 3 is a partially exploded side elevational view of the hinge assembly of FIG. 2.

Referring to FIGS. 2 and 3, the swash plate assembly 18 and the rotor assembly 20 are shown in greater detail. The rotor assembly 20 includes a pair of spaced apart parallel support members 40 integrally formed and extending from an outer surface 42 of the rotor 22. Each of the support members 40 includes a slot 44 formed therein. As best shown in FIG. 3, the slots 44 are kidney shaped. Although the slots 44 can be ovular, obround, circular, or any other shape as desired. While the support members 40 are illustrated as separate, the support members 40 can be integrally formed to form one support member 40.

The swash plate assembly 18 includes a centrally disposed aperture 27 for receiving the drive shaft 24 therethrough. The swash plate assembly 18 includes a substantially flat swash plate 28 and a hub 30. The swash plate 28 is variably angled relative to the rotor assembly 20 between a minimum angle and a maximum angle. The swash plate 28 is adapted to adjust the capacity of the compressor 10 by operating between the minimum angle and the maximum angle such as described in U.S. Pat. No. 7,021,193, hereby incorporated herein by reference in its entirety. In the embodiment shown, the hub 30 is integrally formed with the swash plate 28 and extends outwardly from a surface 31 of the swash plate 28. The swash plate assembly 18 is formed of a copper alloy such as described in U.S. Pat. No. 5,974,946, hereby incorporated herein by reference in its entirety. The swash plate assembly 18 can also be formed of an aluminum alloy such as described in U.S. Pat. No. 6,116,145, hereby incorporated herein by reference in its entirety. The aluminum alloy can have a silicon content greater than 5% by mass. Although, other high-strength materials can be used without departing from the scope of the present disclosure. Additionally, the swash plate assembly 18 can contain surfaces treated with, applied with, and/or coated with a seizure resistant layer such as tin, $MoS_2$, PTFE, or any other low friction treatment or coating, for example.

Figure 4:
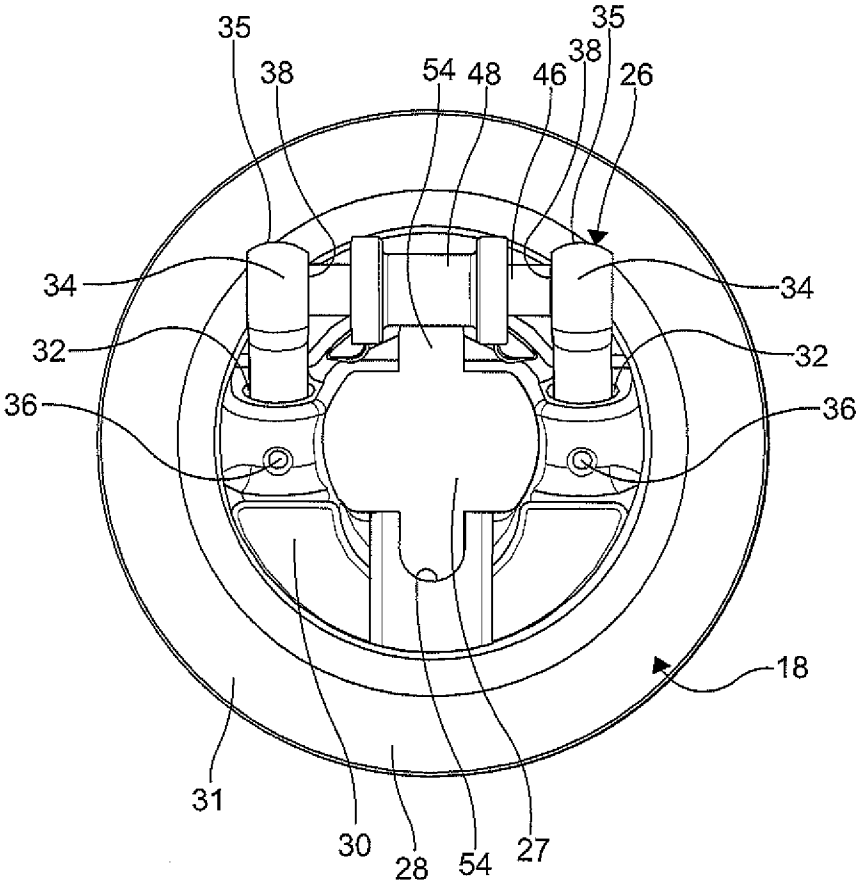
FIG. 4 is a side elevational view of a pair of arms coupled to the swash plate assembly of FIG. 2.

As more clearly shown in FIG. 4, the hub 30 includes a pair of apertures 32 for receiving a pair of arms 34 of the hinge assembly 26 therein. In the embodiment shown, the arms 34 are press fit into the apertures 32 at one end thereof and secured and positioned by a pair of locating pins 36. However, it is understood that other positioning and securement means can be employed such as a bolt, screw, more than two pins or any other positioning and securement means. Each of the arms 34 extends outwardly from the hub 30 and includes an aperture 38 disposed at a distal end 35 thereof spaced from the hub 30. As shown, the arms 34 are produced from a high strength material such as steel, although the arms 34 could be produced of other high strength materials such as titanium, or other similar high strength, rigid, durable metals or metal alloys. The distal end 35 of the arms 34 have a substantially spherical shape, wherein a diameter of the arm at the distal end 35 is larger than a width of the slot 44 in the support members 40. However, the distal end 35 of the arms 34 can have any shape as desired such as cubical, cuboidal, conical and cylindrical or any other shape, or include at least one substantially planar surface.

The hinge assembly 26 includes the support members 40 of the rotor assembly 20 and the arms 34 received in the apertures 32 of the hub 30. The arms 34 are spaced apart to receive the support members 40 therebetween and align the apertures 38 of the arms 34 with the slots 44 of the support members 40. The hinge assembly 26 further includes a hinge pin 46 that extends between the arms 34 and is received through the apertures 38 and slidingly received in the slots 44 of the support members 40. The hinge pin 46 is press fit through a fitted sleeve 48 to maintain the hinge pin 46 in place. The hinge pin 46 can be formed from any durable material such as steel, titanium, aluminum, other metal or metal alloy, or any other material as desired. The sleeve 48 is be formed from a lightweight material such as aluminum, for example.

Figure 5:
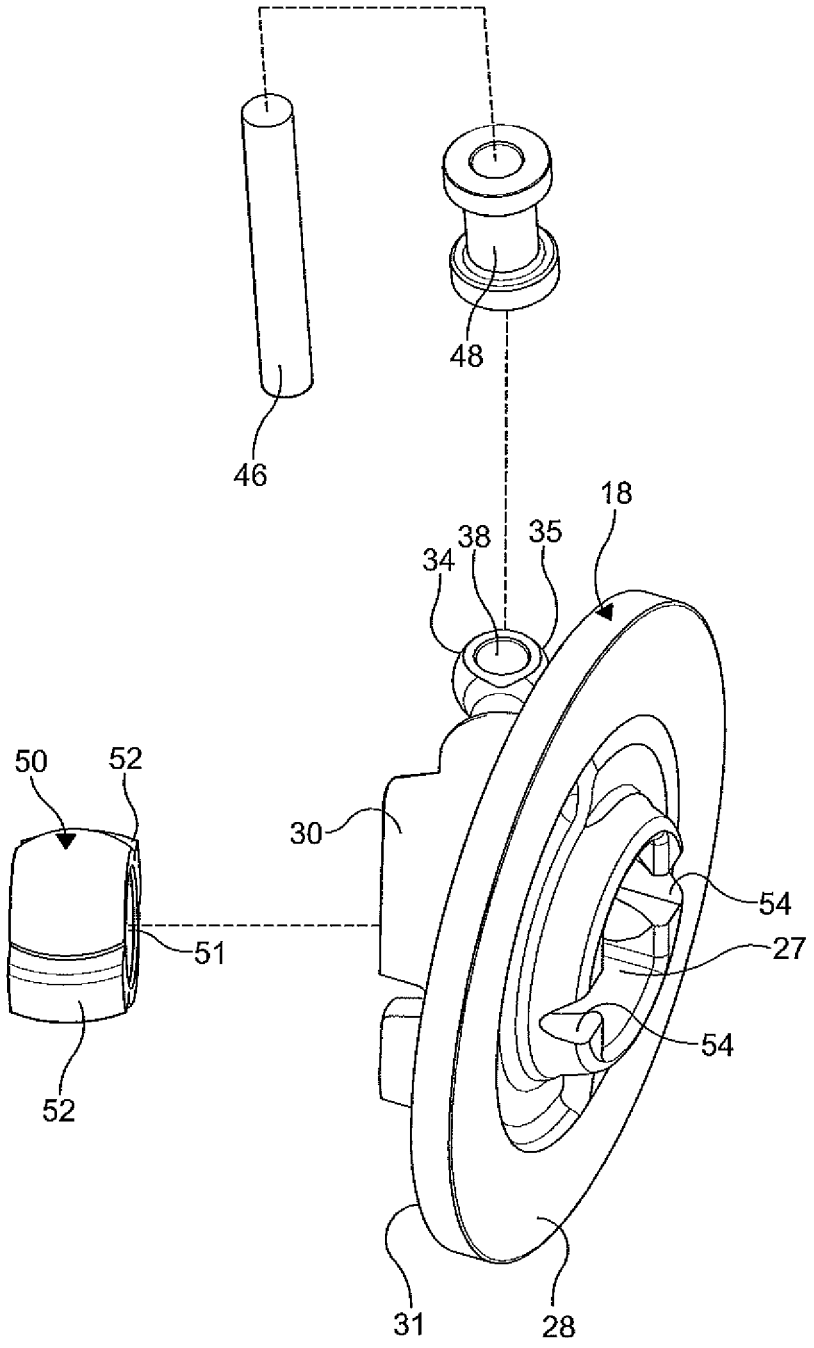
FIG. 5 is a partially exploded side perspective view of the swash plate assembly of FIGS. 2 and 4.

As illustrated in FIG. 5, a guide 50 is slidably mounted to the drive shaft 24 and received within the aperture 27 of the swash plate assembly 18 to rotatably and slidably engage the drive shaft 24 with the swash plate assembly 18. An aperture 51 is formed in the guide 50 to receive the drive shaft 24 therein. The guide 50 can be a substantially spherical bushing or sleeve and includes flanges 52 extending radially outwardly therefrom. The flanges 52 interface with recesses 54, as best shown in FIG. 4, formed in the hub 30 of the swash plate 28 and are adapted to allow the swash plate 28 to tilt about the guide 50 as the swash plate 28 is angled in respect of the rotor 22. The recesses 54 correspond to a shape of the flanges 52. In certain embodiments, the guide 50 includes two diametrically opposed flanges 52 aligned with a longitudinal direction of the arms 34 extending from the hub 30 of the swash plate assembly 18. However, the guide 50 can include any number of flanges such as one flange or three or four flanges extending radially outwardly from the guide 50.

The compressor 10 is referred to as a variable displacement compressor because a total displacement, due to an amount of the reciprocal motion of the pistons 16 within the cylinders 14, may be adjusted by changing the inclination angle of the swash plate 28, thereby changing a refrigerant pumping capacity of the compressor 10. In operation, the drive shaft 24 is caused to rotate by the auxiliary drive means which causes the rotor assembly 20 to rotate. The rotation of the rotor assembly 20 causes the swash plate assembly 18 to rotate. The rotation of the swash plate assembly 18 causes the pistons 16 to reciprocate within the cylinders 14 of the cylinder block 12 through sliding or rolling engagement with the bearing shoes 17.

By changing the inclination angle of the swash plate 28, a length of a stroke of the pistons 16 is changed. The swash plate 28 is caused to change inclination angles between a minimum angle and a maximum angle. The minimum angle of the swash plate 28 causes the pistons 16 to operate at a minimum displacement and the maximum angle of the swash plate 28 causes the pistons 16 to operate at a maximum displacement. The inclination of the swash plate 28 changes based on pressure differentials within the compressor 10 as is commonly known and disclosed in U.S. Pat. No. 7,021,193, hereby incorporated herein by reference in its entirety. At the maximum angle, the hinge pin 46 is caused to move slidably and outwardly with respect to the drive shaft 24 within the slots 44 of the support members 40. Conversely, at the minimum angle, the hinge pin 46 is caused to move slidably and inwardly with respect to the drive shaft 24 within the slots 44 of the support members 40. The shape of the slots 44 of the support members 40 maintain a constant TDC position of the pistons 16 regardless of the angle of the swash plate 28 by supporting a resulting load acting on the swash plate 28 from the reciprocating motion of the pistons 16.

The guide 50 allows the swash plate 28 to move axially along the drive shaft 24 and facilitates the varying of the inclination angle of the swash plate 28. The helical spring 25 urges the guide 50 to move axially along the drive shaft 24 in a direction away from the rotor assembly 20. The swash plate 28 engages with the guide 50 and the flanges 52 formed thereon to facilitate smooth transition of the swash plate 28 from minimum angle to maximum angle and vice versa. The recesses 54 of the swash plate 28 cooperate with the flanges 52 to militate against the swash plate 28 tilting or wobbling about an axis normal to a longitudinal axis of the drive shaft 24. The flanges 52 further facilitate a reduction of friction of the hinge assembly 26.

As the swash plate 28 changes inclination angles, the hinge assembly 26 maintains a low hysteresis and provides a constant support and maintains balance under a resultant load of the swash plate 28 which causes the TDC position of the pistons 16 to remain substantially constant. The hinge assembly 26 is easily assembled and allows the swash plate assembly 18 to exhibit necessary bearing properties. The hinge assembly 26 is durable and militates against friction.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A hinge assembly for coupling a rotor assembly to a swash plate assembly in a variable displacement compressor comprising:

a hub integrally formed with the swash plate assembly;

a pair of spaced part arms coupled to the hub and extending outwardly therefrom, each of the arms having an aperture, formed in a distal end thereof, wherein each of the arms is received within an aperture formed in the hub and retained therein by at least one locating pin;

a pair of support members extending from the rotor assembly, each of the pair of support members having a slot formed therein;

and a hinge pin slideably received in the slot of each of the pair of support members and received in the aperture of each of the arms to hingedly couple the arms to the pair of support members.

2. The hinge assembly of claim 1, wherein the hub includes a pair of apertures and the arms are press fit in the apertures.

3. The hinge assembly of claim 1, wherein the hub and a swash plate of the swash plate assembly are formed from one of a copper alloy and an aluminum alloy, the aluminum alloy having a silicon content greater than 5% by mass.

4. The hinge assembly of claim 1, wherein each of the arms is formed from steel.

5. The hinge assembly of claim 1, wherein the distal end of each of the arms is spherical shaped.

6. The hinge assembly of claim 1, wherein the slot of each of the pair of support members is kidney shaped.

7. The hinge assembly of claim 1, wherein each of the support members is interposed between the pair of spaced apart arms.

8. The hinge assembly of claim 1, further comprising a fitted sleeve interposed between the pair of arms and receiving the hinge pin to maintain a position of the hinge pin.

9. The hinge assembly of claim 1, further comprising a guide received within an aperture centrally formed in the swash plate assembly.

10. The hinge assembly of claim 9, wherein the guide includes at least one flange extending radially outwardly therefrom, the at least one flange received in at least one recess formed in the swash plate assembly.

11. A variable displacement compressor comprising:

a housing including a cylinder block and a drive shaft disposed therein, the cylinder block having a plurality of cylinders formed therein and a plurality of pistons each received within each of the cylinders;

a rotor rotatably coupled to the drive shaft;

a swash plate assembly slideably coupled to the pistons to cause a reciprocating motion thereof, the swash plate assembly including a swash plate and a hub integrally formed with the swash plate;

a hinge assembly operatively and pivotally coupling the swash plate assembly to the rotor, the hinge assembly including:

a pair of arms press fit into a pair of apertures formed in the hub and extending outwardly therefrom, wherein each of the pair of arms is retained in the hub by at least one locating pin;

at least one support member extending from the rotor and having a slot formed therein; and a hinge pin slideably received in the slot of the at least one support member and hingedly coupling the arms to the at least one support member.

12. The hinge assembly of claim 11, wherein the swash plate and the hub of the swash plate assembly are formed from one of a copper alloy and aluminum alloy and one of coated with a low friction material and applied with a low friction material.

13. The hinge assembly of claim 11, wherein the slot is kidney shaped.

14. The hinge assembly of claim 11, further comprising a fitted sleeve interposed between the pair of arms and receiving the hinge pin to maintain a position of the hinge pin.

15. The hinge assembly of claim 11, further comprising a guide received within an aperture centrally formed in the swash plate assembly.

16. The hinge assembly of claim 15, wherein the guide includes at least one flange extending radially outwardly therefrom, the at least one flange received in at least one recess formed in the swash plate assembly.

17. A variable displacement compressor comprising:

a housing including a cylinder block and a drive shaft disposed therein, the cylinder block having a plurality of cylinders formed therein and a plurality of pistons each received within each of the cylinders;

a rotor assembly rotatingly coupled to the drive shaft and including a pair of support members extending therefrom, each of the pair of support members having a slot formed therein;

a swash plate assembly having an aperture and at least one recess formed therein, the swash plate assembly operatively engaging with the plurality of pistons to cause a reciprocal motion thereof, the swash plate assembly including a swash plate and a hub integrally formed with the swash plate;

a pair of arms coupled to the hub and extending outwardly therefrom, each of the pair of arms having an aperture formed in a distal end thereof, wherein each of the arms is received within an aperture formed in the hub and retained therein by at least one locating pin;

a hinge pin slideably received in the slot formed in each of the pair of support members and the aperture of each of the arms to hingedly couple the rotor assembly to the swash plate assembly; and a guide received in the aperture of the swash plate assembly, the guide having at least one flange received in the at least one recess of the swash plate assembly.

18. A hinge assembly for coupling a rotor assembly to a swash plate assembly in a variable displacement compressor comprising:

a hub integrally formed with the swash plate assembly;

a pair of spaced apart arms coupled to the hub and extending outwardly therefrom, each of the arms having an aperture formed in a distal end thereof, wherein each of the arms is received within an aperture formed in the hub and retained therein by at least one locating pin;

at least one support member extending from the rotor assembly and having a slot formed therein; and a hinge pin slideably received in the slot of the at least one support member and received in the aperture of each of the arms to hingedly couple the arms to the at least one support member.

19. A variable displacement compressor comprising:

a housing including a cylinder block and a drive shaft disposed therein, the cylinder block having a plurality of cylinders formed therein and a plurality of pistons each received within each of the cylinders;

a rotor assembly rotatingly coupled to the drive shaft and including at least one support member extending therefrom, the at least one support member having a slot formed therein;

a swash plate assembly having an aperture and at least one recess formed therein, the swash plate assembly operatively engaging with the plurality of pistons to cause a reciprocal motion thereof, the swash plate assembly including a swash plate and a hub integrally formed with the swash plate;

a pair of arms coupled to the hub and extending outwardly therefrom, each of the pair of arms having an aperture formed in a distal end thereof, wherein each of the arms is received within an aperture formed in the hub and retained therein by at least one locating pin;

a hinge pin slideably received in the slot formed in each of the pair of support members and the aperture of each of the arms to hingedly couple the rotor assembly to the swash plate assembly; and a guide received in the aperture of the swash plate assembly, the guide having at least one flange received in the at least one recess of the swash plate assembly.

* * * * *